US005360589A

United States Patent [19]

Wandel et al.

[11] Patent Number: 5,360,589

[45] Date of Patent: Nov. 1, 1994

[54] PROCESS FOR PRODUCING SYNTHETIC FILAMENTS

[75] Inventors: Dietmar Wandel, Hanau; Gunter Koschinek, Dietzenbach, both of Germany

[73] Assignee: Zimmer Aktiengesellschaft, Frankfurt, Germany

[21] Appl. No.: 73,575

[22] Filed: Jun. 7, 1993

[30] Foreign Application Priority Data

Jul. 15, 1992 [DE] Germany ..... 4223198

[51] Int. Cl.[5] ..... B29C 35/16; D01D 5/12

[52] U.S. Cl. ..... 264/211.12; 264/237; 425/72.2

[58] Field of Search ..... 264/211.12, 211.14, 264/237; 425/72.2

[56] References Cited

U.S. PATENT DOCUMENTS 4,496,505 1/1985 Tanji et al. ..... 264/101
4,529,368 7/1985 Makansi ..... 425/72.2
4,712,988 12/1987 Broaddus et al. ..... 425/72.2
5,234,327 8/1993 Martin ..... 425/72.2

FOREIGN PATENT DOCUMENTS 1914556 3/1970 Germany .
1220424 1/1971 United Kingdom ..... 264/237
2135629 9/1984 United Kingdom .

*Primary Examiner*—Leo B. Tentoni
*Attorney, Agent, or Firm*—Allegretti & Witcoff, Ltd.

[57] ABSTRACT

A process for producing spin-oriented continuous filaments at a draw-off speed of more than 2400 m/min, whereby the filaments extruded through the spinnerets of the spinning heads are cooled in cooling shafts by the ambient air entrained as a result of the suction action of the filaments and the filaments leaving the cooling shafts enter a chamber that is separate from the intake environment where the air pressure is regulated at a lower pressure in comparison with the air pressure in the intake environment.

1 Claim, 1 Drawing Sheet

PROCESS FOR PRODUCING SYNTHETIC FILAMENTS

BACKGROUND OF THE INVENTION

This invention concerns a process for spinning and cooling spin-oriented multifilaments by means of a spinning apparatus having spinning heads containing spinnerets and cooling shafts with an air-permeable wall through which a stream of air is sucked into the interior of the cooling shaft solely by the frictional entrainment of air by the filaments.

Multifilament continuous filaments of synthetic polymers are produced from a melt at the spinning temperature by means of a spinning device. The melt is forced through boreholes in a spinneret. The resulting melt streams are then cooled and combined to form a filament bundle, which is treated with a spin finish oil, then drawn off with a fiber draw-off device and finally wound onto tubes to form a bobbin.

Cooling is especially important here. The uniformity of cooling has a direct influence on the physical characteristics of the filaments such as uniformity of the Uster-value or dyeing receptivity. Trouble is caused by non-laminar or turbulent flow of the cooling air. Before the melt streams which arc extruded at a high spinning temperature have cooled below the solidification point, contact with each other or with the thread guides have to be avoided because they would stick.

PRIOR ART

Systems with cool air processing in a climate-controlled installation and feeding of the air through air ducts to cooling shafts and blowing the air by means of fans into the area of the melt streams below the spinnerets have proven successful. However, complicated air distribution systems, controls and homogenization equipment must be used in order to guide the turbulent cooling air and maintain laminar flow.

Practical examples of these systems include those with cross flow, i.e., essentially air flow at right angles to the filaments and direct removal of the heat of melting on the leeward side (U.S. Pat. No. 4,529,368) as well as those with radial flow, i.e., air is directed from the outside into the filament bundle and heat is dissipated essentially in the direction of travel of the filament (U.S. Pat. No. 4,712,988 and German Patent A 3,406,347).

Another conventional method of producing a stream of cooling air consists of passing the filaments through a suction device where a stream of cooling air is produced on the basis of a vacuum effect (U.S. Pat. No. A 4,496,505 and International patent WO 90-02222A).

In addition, a device for spinning and cooling synthetic continuous filaments is also known from German Patent A 1,914,556, whereby the required cooling air stream is created in a shaft that is provided with numerous perforations through which a bundle of melt streams extruded from a die plate is passed. The velocity of the stream of cooling air depends on the velocity of the fibers. Accordingly, the air velocity near the spinneret is minimal and then increases suddenly after that. In order to create a constant stream of cooling air, German Patent A 1,914,556 therefore proposes that the zone following the spinneret be designed without perforations with a length of at least 300 mm so that access of outside air is prevented in this area. Consequently, the length of the total required cooling zone is greater.

THE INVENTION

The object of this invention is to provide a process for spinning and cooling synthetic continuous filaments that will consume only a small amount of energy, will require minimal control technology, require the smallest possible length of the cooling zone and will be suitable for operation at high draw-off speeds. The object is achieved by sucking the air stream into the cooling shaft directly beneath the spinnerets and without interruption along the cooling shaft solely by the frictional entrainment of the air by the filaments, and then when the filaments leave the cooling shaft, they enter a chamber that is separated from the intake environment, in which chamber the air pressure is regulated at a lower pressure in comparison with the pressure prevailing in the intake environment. The process is carried out at draw-off speeds of at least 2400 m/min.

In a departure from the teachings of German Patent DE A 1,914,556 cited above, cooling air derived from the outside ambient air is supplied to the melt streams directly beneath the spinnerets. This cooling air is sucked into the shaft because of the friction effect between the air and the filaments guided through the respective zones of the cooling shaft. To a certain extent this is comparable to an injector effect. This entrainment effect extends along the entire length of the cooling shaft and includes the area directly beneath the spinnerets so the melt streams to be cooled are subjected to a cooling effect immediately after leaving the spinneret. The regulated lower pressure of the chamber at the outlet end results in an increase in the velocity of flow of the air sucked into the cooling shaft, especially in the area directly following the spinneret. The cooling shaft provides a channelizing effect of the air along the direction of the filaments such that the air flow uniformly surrounds the filaments and thus results in a constant and uniform cooling effect.

It has surprisingly been found that a cooling effect produced as described above extending especially to the area directly beneath the spinneret at high draw-off speeds, produces filaments that have high uniformity over their entire length, as well as between one monofilament and the next. Such uniformity cannot be achieved when using the apparatus according to German Patent A 1,914,556, even in combination with a draw-off speed of more than 2400 m/min.

In particular under spinning and cooling conditions that are otherwise the same—such as the titer and draw-off speed—a higher velocity of flow of the entrained cooling air can be achieved and adjusted in a controlled manner by means of the vacuum in the chamber downstream of the cooling shaft. This is in contrast with the usual intake systems. This process quickly cools the filaments to temperatures below the solidification point and also permits bundling the filaments within a shorter spinning distance.

In addition this process yields an important practical advantage compared with enormously expensive traditional cooling systems where an excess pressure or a reduced pressure is applied to cool the filaments by air. By eliminating such air pressure generators, this invention makes it possible to produce filaments in a practical and advantageous manner at reduced cost. Eliminated are separate climate control systems which are associated with an especially high energy consumption as well as air ducts and homogenization devices required to create a laminar flow of the turbulent air. The only equipment needed is a differential pressure regulation device for the air intake area and the filament discharge chamber which are climatized anyway.

When using the process according to this invention, the average distance between the single filaments in a filament bundle on leaving the cooling shaft can be less than 6 mm because of the particularly high uniformity of the air flow and the rapid cooling of the filaments. Preferably a bundling filament guide that combines the filaments to form a thread is installed directly at the outlet of the cooling shaft. This permits a short spinning length which in turn permits a low thread tension when using a high draw-off speed and also permits an advantageous design of the spinning apparatus.

Favorably, the process according to this invention is suitable for producing single filament titers of 0.3 to 3.0 dtex at a draw-off speed of 2400 to 8000 m/min. But even higher titers up to 8 dtex could be cooled down by still acceptable uniformity of the quality figures.

The equipment for carrying out the process according to this invention is designed in such a way that the cooling shafts are connected directly to the lower end of the spinning heads, the walls of the cooling shafts are provided with perforations to allow access of air over the entire lengths of the shafts and the filament discharge cross section is connected to a chamber that is separate from the intake environment and where the air pressure is regulated at a lower pressure in comparison with the air pressure prevailing in the intake environment. The air permeable wall can be formed of a mesh cloth or with perforations, small holes or slots. The shape of the cooling shaft depends on the shape of the die plates which may be round, oval or rectangular. Accordingly, the cooling shaft has a circular, oval or rectangular cross section which is preferably 10 to 60 mm larger than that of the orifice field of the spinneret.

The entire spinning apparatus, from the spinning head to the winding device, is set up, as known of the art, within an air conditioned area with airlocks. This measure is necessary in order to prevent excessive heating up of the area from the heat which radiates during spinning at temperatures of the order of magnitude of 300° C., as well as to prevent air turbulence during the opening of the door to the area.

Because of its total height of several meters, the spinning apparatus normally extends over two stories. In accordance with this invention, the spinning head and the cooling shaft are accommodated within the upper story, and the area below the shaft, which essentially comprises a bundling thread guide, a thread lubricating device, a winding device and, if applicable, a draw off-godet system, is accommodated within the lower story, whereby the ceiling between the two stories is tightened to the cooling shafts. Both of the stories are air conditioned; cooled air is therefore continuously fed into the area, and heated air is conducted away.

Instead of the arrangement involving two stories with the ceiling tightened to the cooling shafts, it is also possible to accommodate the area below the cooling shaft in a climate controlled chamber. In this case it can be simply a box which need only be large enough to prevent any direct effect of the air flow from the climate control system on the filaments.

A simple differential pressure regulator for these two chambers or stories can assure that the air pressure in the lower space will be lower than the air pressure in the upper space, which corresponds to the intake environment of the cooling shafts. The pressure difference between the two areas is preferably 2 to 20 Pa where preferably the pressure difference should be higher as the draw-off speed of the filaments becomes lower.

BRIEF DESCRIPTION OF THE DRAWING

There is shown in the attached drawing a presently preferred embodiment of the invention, wherein.

DETAILED DESCRIPTION OF THE PRESENT INVENTION

Figure 1:
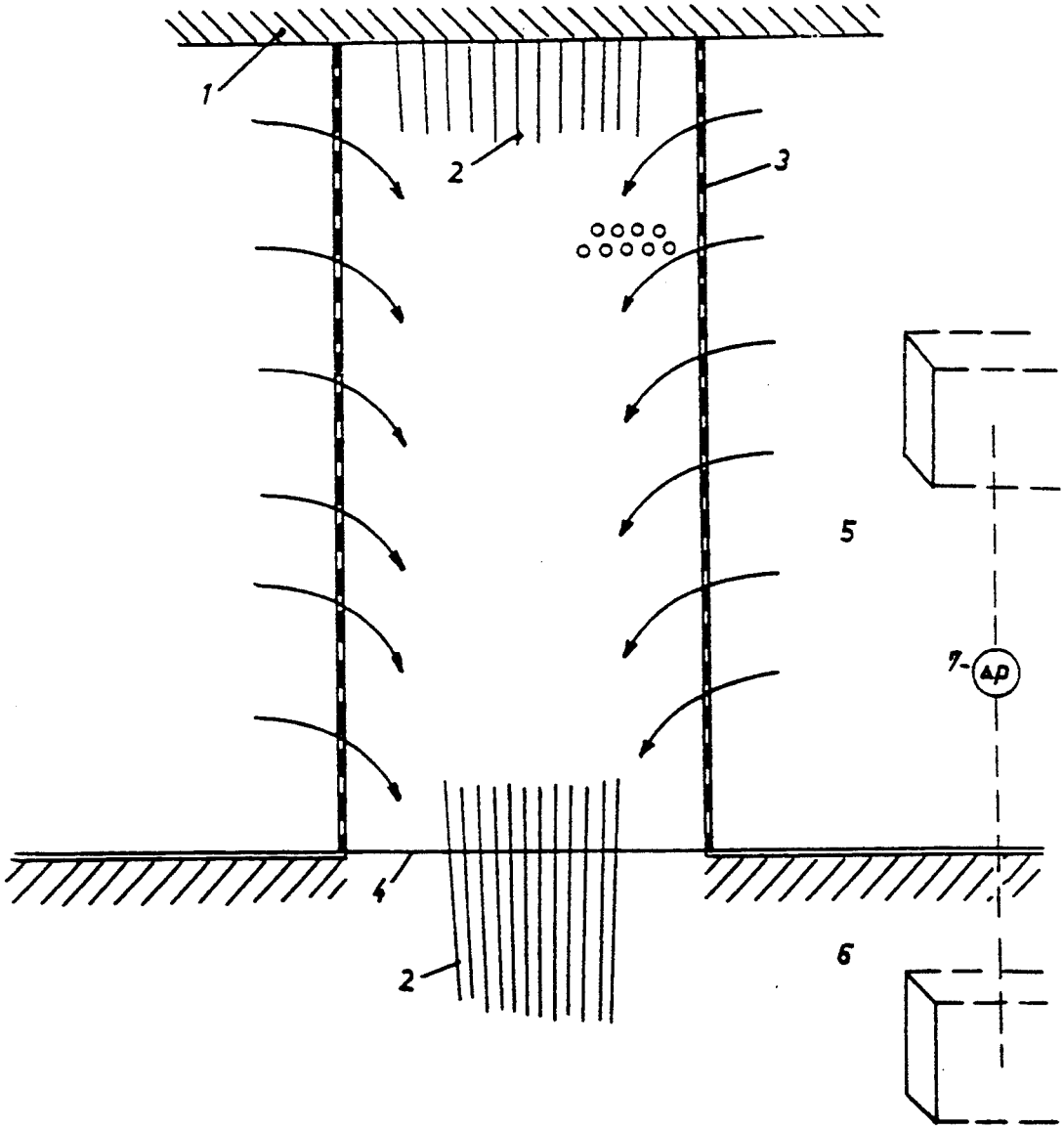
FIG. 1 is a schematic cross sectional view of a cooling shaft extending in the upper story from a spinning head to the ceiling of the lower story with both stories climate and pressure controlled.

Although a commercial spinning apparatus has multiple spinning heads, the drawing illustrates only a single head and a single cooling shaft.

FIG. 1 shows in schematic form an example of a cooling shaft extending from the lower side 1 of the spinning head and concentrically surrounds the filaments 2 leaving the spinneret. The shaft is essentially a metal cylinder 3.

Metal cylinder 3 has holes or perforations distributed uniformly over the walls whereby the air permeability can be varied over a wide range. However, the air resistance should not be so great as to impair the suction effect. Excessively large perforations should also be avoided in order to buffer the movement of air in the vicinity. A perforated, open area which comprises a maximum of 50% of the total surface area of the wall has proven appropriate.

Since each filament bundle is surrounded by the cylinder wall 3 of the cooling shaft, the cooling air drawn in through the suction effect of the moving filaments (note the arrows in FIG. 1) is directed essentially radially from the outside to the inside. It is drawn from the environment and therefore has a temperature corresponding to the temperature of the spinning enclosure.

The lower chamber 6 is separate from the intake environment 5 but is connected to the cooling shaft through the outlet opening 4. A pressure difference regulator 7 makes it possible to adjust a reduced pressure in chamber 6 in comparison with the pressure in the intake environment 5.

Below the cooling shaft, there is a thread oiling device (not shown) or some other type of thread guide for bundling the solidified filaments to form a thread which is then guided to a draw-off device and wound onto tubes to form a bobbin.

EXAMPLE 1

Polyethylene terephthalate (PET) chips with an intrinsic viscosity (measured at 25° C., 0.5 g polyester in 100 ml phenol+1,2-dichloro benzol (3:2)) of 0.63 dl/g were melted, and the melt was extruded through the orifices or nozzles of a spinneret at a temperature of 294° C. The spinneret had a diameter of 80 mm. The orifice field diameter was 70 mm and the diameter of each orifice was 0.25 mm the length, L=2 D. The number of orifices in the spinneret was 34.

The polymer delivery rate was 26.3 g/min yielding a titer of 83f34 dtex which corresponds to a spinning titer of 2.44 dtex per single filament.

The cooling shaft in the form of a perforated metal cylinder with a diameter of 100 mm was connected to the spinning head directly. The length was 800 mm and the hole diameter was 5 min. The holes (2730 holes) were uniformly distributed over the wall. The open area of the wall equals 34%. The cooling shaft was surrounded by ambient air at a temperature of 29° C.

The lower outlet of the cooling shaft 3 was flange-connected directly to a chamber. The dimensions of the chamber were as follows:

width × height × depth = 200 mm × 500 mm × 500 mm.

A connector tube with a diameter of 80 mm was mounted on the rear wall of the chamber and was connected to a water jet pump. The reduced pressure in the chamber was regulated by regulating the water pressure.

The filaments were bundled in a thread oiler localized in the chamber a distance of 100 mm from the lower outlet of the cooling cylinder. The thread was discharged from the lower end of the chamber through a ceramic eye with a diameter of 2 mm. For access to the thread, the front side of the chamber could be opened to such an extent that the thread could be threaded into the thread oiler and into the discharge eye.

Then the filament bundle was drawn off at the speed of 3200 m/min and wound onto a tube to form a bobbin directly by a bobbin winder that was equipped for compensation of tension by means of a grooved roller operated with an overfeed speed of 13%.

The water pressure of the water jet pump was varied next. At a zero setting, the thread running properties were very irregular. Uster values measured on the thread wound onto the bobbin varied greatly, averaging to ≧0.62% (H. I.).

At a water pressure of 2 bar ($2\times10^5$ Pa) the pressure in the chamber was reduced by 10 Pa. The thread running was smooth and the filament thickness uniformity was excellent.

The following characteristics were achieved:

| | |
|---|---|
| Titer (dtex) | 82.9 |
| Breaking Load (cN) | 214.2 |
| Tenacity at Break (cN/tex) | 25.8 |
| Elongation at Break (%) | 121.1 |
| Uster Half Inert (%) | 0.33 |

At a water pressure of 3 bar ($3\times10^5$ Pa) the pressure difference equalled 20 Pa. The thread running properties were still good. There was practically no change in the thread properties.

EXAMPLES 2, 3 and 4

Using the spinning equipment according to Example 1, the draw-off speed of the thread was varied while maintaining a uniform reduced pressure setting in the chamber of 20 Pa pressure difference. At the same time the polymer delivery was varied in order to adjust the titer.

The characteristics achieved with these specifications were as follows:

| Example | 2 | 3 | 4 |
|---|---|---|---|
| Speed (m/min) | 4200 | 5200 | 5800 |
| Delivery (g/min) | 34.9 | 42.5 | 65.0 |
| Titer (dtex) | 82.7 | 82.9 | 112.7 |
| Breaking Load (cN) | 263.0 | 296.0 | 366.3 |
| Tenacity at Break (cN/tex) | 31.8 | 35.7 | 32.5 |
| Elongation at Break (%) | 84.9 | 65.6 | 49.2 |
| Uster Half Inert (%) | 0.36 | 0.26 | 0.28 |

The thread running behavior was smooth and the filament Uster uniformity achieved was excellent.

EXAMPLES 5 and 6

Using the spinning equipment according to Example 1, the cooling shaft was changed for a perforated cylinder of a length of 970 mm with the same hole density as before. The same chamber was tightened to the outlet of the shaft. The bundling thread oiler was positioned at a distance of 230 mm beneath the shaft. The winder speed was set at 3200 m/min, the overfeed of the grooved roll was set at 8%. The polymer delivery was increased to 64.5 g/min. to adjust the spin tiler at 200 dtex which means a single filament liter of 5.9 dtex. The water pressure of the pressure control system was varied with following results:

| Example | 5 | 6 |
|---|---|---|
| Water pressure (bar) | 0 | 3 |
| Differential Pressure (Pa) | 0 | 20 |
| Titer (dtex) | 201 | 202 |
| Breaking Load (CN) | 370 | 500 |
| Tenacity at Break (cN/tex) | 18.4 | 24.8 |
| Elongation at Break (%) | 112 | 129 |
| Uster Half Inert (%) | 1.2–1.5 | 0.55 |

The thread running behavior was unstable in Example 5. Uster values were varying while running performance was smooth and stable in Example 6.

We claim:

1. A process for producing spin-oriented filaments consisting of providing a spinning head connecting directly to a cooling shaft having perforated walls immediately adjacent said head and over the entire length of said shaft, extruding filaments from said head into said shaft, drawing said filaments from a point downstream of the solidification point at a draw-off speed more than 2,400 m/min, cooling said filaments in said shaft by air drawn from an intake environment into said shaft through said perforations by the frictional entrainment of the air by said moving filaments, passing said filaments from said shaft into a chamber separate from said intake environment, and maintaining the air pressure in said chamber from 2 to 20 Pa lower than the air pressure of said intake environment.

* * * * *